US005732425A

United States Patent [19]

Leung

[11] Patent Number: 5,732,425

[45] Date of Patent: Mar. 31, 1998

[54] THERAPEUTIC TABLE WITH GAS SPRING ASSIST LIFT FOR HEIGHT ADJUSTABLE TABLE TOP

[76] Inventor: Shun Leung, 4725 Sheppard Avenue East, Apt. 1515, Scarborough, Ontario, Canada, M1S 5B2

[21] Appl. No.: 840,819

[22] Filed: Apr. 16, 1997

[51] Int. Cl.[6] ..... A61G 13/06

[52] U.S. Cl. ..... 5/611; 5/11; 108/145

[58] Field of Search ..... 5/11, 611; 108/145; 254/10 R, 10 C

[56] References Cited

U.S. PATENT DOCUMENTS

| | | | |
|---|---|---|---|
| 2,747,919 | 5/1956 | Ferneau et al. | 5/611 X |
| 3,887,950 | 6/1975 | Wachsman | 5/11 |
| 4,073,240 | 2/1978 | Fly | 108/145 X |
| 5,245,718 | 9/1993 | Krauska | 5/611 X |
| 5,365,622 | 11/1994 | Schirmer | 5/611 |
| 5,490,298 | 2/1996 | Goldsmith et al. | 5/611 |

*Primary Examiner*—Michael F. Trettel

[57] ABSTRACT

A therapeutic table has a base, a bed-like table top, adjustable legs to provide height adjustment of the table top, a gas spring which provides an upward lift on and at least substantially neutralizes weight of the table top and a lock having numerous locking positions for locking the table top at different heights to which it is adjusted.

3 Claims, 3 Drawing Sheets

39
37
5
41
53
5
29
31
51
55
49
45
57
43
33
47
35

THERAPEUTIC TABLE WITH GAS SPRING ASSIST LIFT FOR HEIGHT ADJUSTABLE TABLE TOP

FIELD OF THE INVENTION

The present invention relates to a height adjustable therapeutic table used as a patient bed by doctors and chiropractors.

BACKGROUND OF THE INVENTION

Therapeutic tables, as used by doctors and chiropractors, require frequent height adjustment depending upon the height of the particular practitioner involved as well as the exercise or inspection to be carried out on the patient.

A conventional therapeutic table is one in which the bed top is manually raised or lowered by the practitioner without the patient on the bed. Even without weight of the patient, these bed tops are quite heavy which, in combination with the fact that the practitioner must generally bend over in an awkward position many times a day to change the height of the bed, can result in muscle fatigue and damage.

Some very sophisticated self height adjusting patient tables have been designed in the past. For example, U.S. Pat. No. 3,317,931 describes a height adjustable therapeutic table using a motor and a complex levering system to adjust the height of the table top. This can be done with the patient lying on the table.

U.S. Pat. No. 4,558,648 describes a height adjustable cabinetry platform used for raising and lowering objects. The platform uses a mechanically complex scissor lift which because of the scissor action of the lift, requires two gas assist cylinders. These cylinders cooperate at the bottom of the lift and only one of the cylinders is needed at the top of the lift. In addition, the platform has only a single down position and a single up position and is not designed to be held at any position therebetween.

Currently, there is nothing available in the marketplace in the way of a simple cost efficient therapeutic table with a mechanical assist for adjusting the height of the table top.

SUMMARY OF THE INVENTION

The present invention relates to a therapeutic table having a base, a bed like table top, height adjustable legs to provide height adjustment of the table top, a gas spring providing an upward lift on and at least substantially neutralizing weight of the table top and a lock for locking the table top at different heights to which the table top is adjusted.

The therapeutic table of the present invention is one which effectively overcomes the problems encountered in the past in association with the lifting of the table top of a therapeutic table in a very cost efficient and simple manner.

BRIEF DESCRIPTION OF THE DRAWINGS

The above as well as other advantages and features of the present invention will be described in greater detail according to the preferred embodiments of the present invention in which.

DETAILED DESCRIPTION ACCORDING TO THE PREFERRED EMBODIMENTS OF THE PRESENT INVENTION

Figure 1:
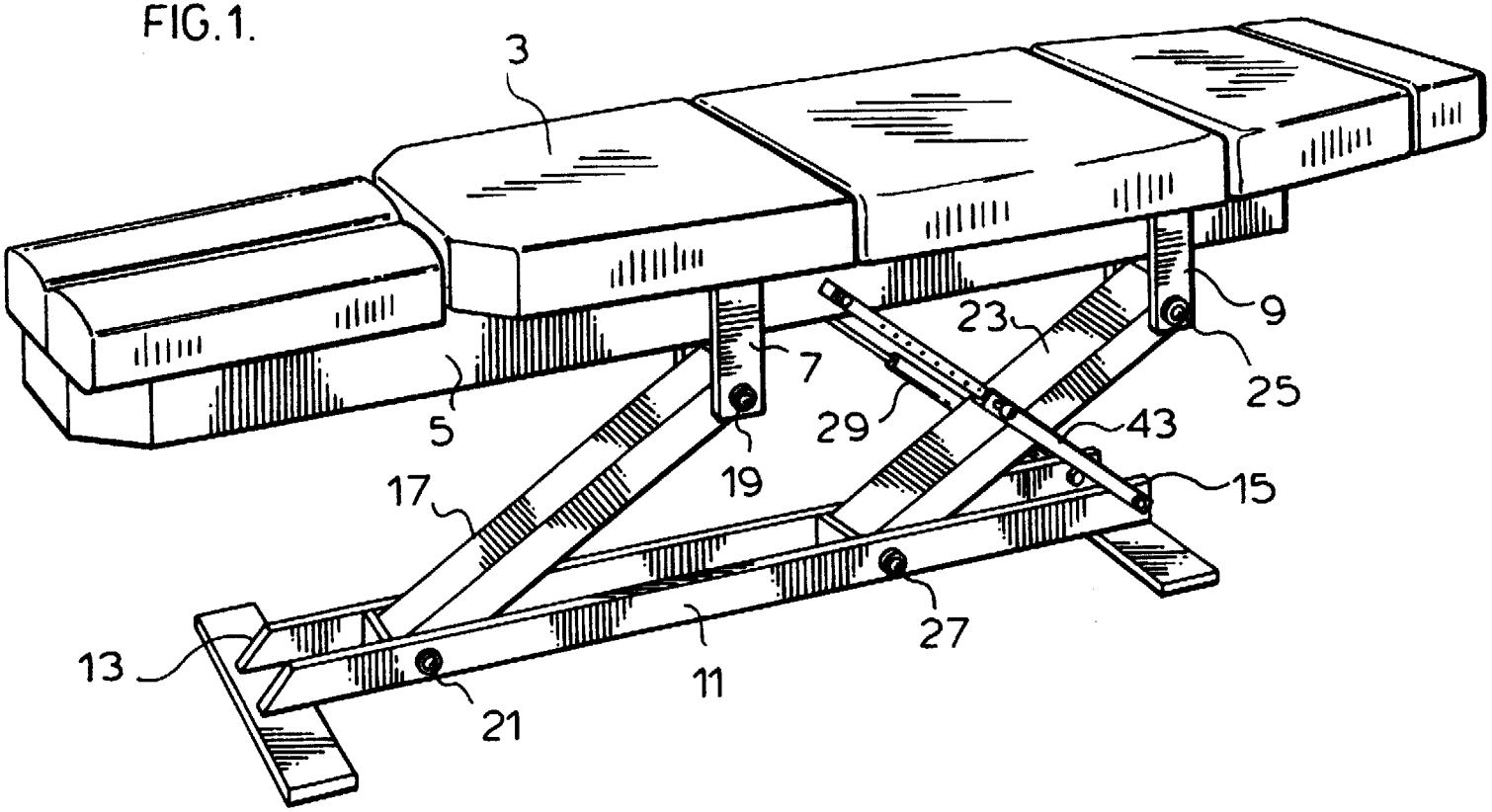
FIG. 1 is a perspective view of a therapeutic table according to a preferred embodiment of the present invention.

FIG. 1 shows a therapeutic table generally indicated at 1. This therapeutic table has a bed-like table top comprising cushions 3 supported by a metal frame member 5. A first and second pair of short brackets 7 and 9 extend downwardly from either side of the frame 5 of the table top.

The table further comprises a base 11 with a pair of legs 17 and 23 between the base and the table top. More specifically leg 17 has an upper end pivotally secured between the two brackets 7 and leg 23 has an upper end pivotally secured between the two brackets 9.

For reference sake, base 11 has a forward end 13 which is generally located below the pillow-like head portion of the table top and a rear end 15 which is generally located below the foot portion of the table top.

Figure 4:
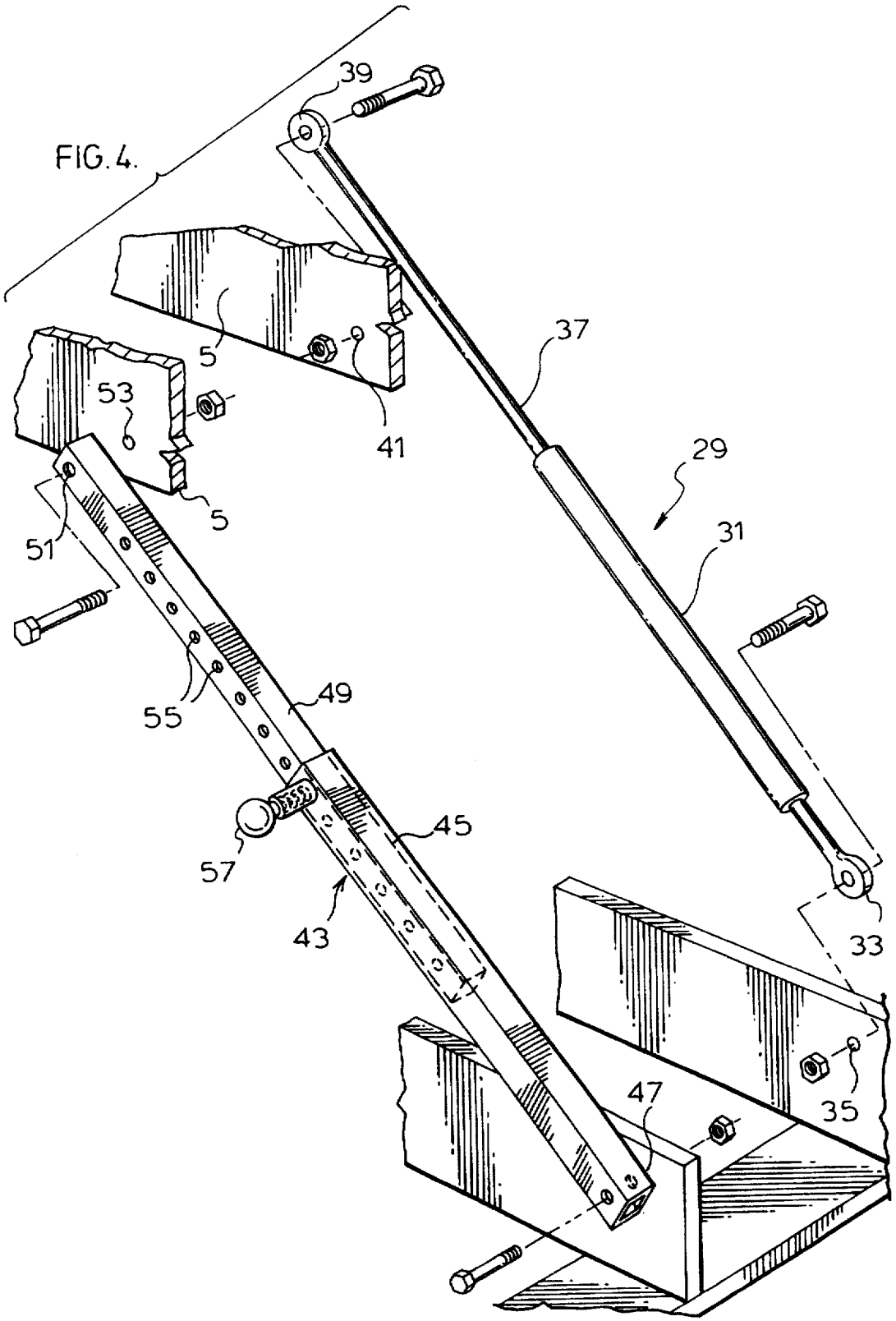
FIG. 4 is an exploded perspective view of the gas spring and height lock of the therapeutic table of FIG. 1.

The bed further comprises a gas spring 29 and a telescopic locking leg 43. Spring 29 and leg 43 are in effect a pair of struts aligned with one another to opposite sides of the table. The connection of these struts to the table is best shown in FIG. 4. Here it will be seen that gas spring 29 comprises a sealed cylinder 31 and a rod 37 which extends and retracts relative to the cylinder. As is known in the gas spring art, rod 37 is normally urged by the gas pressure within cylinder 31 to the extended position shown in FIG. 4. The rod can however be collapsed into the cylinder when pressure is applied on it.

The lower end 33 of the gas spring is pivotally secured at 35 near the rear end 15 of the base 11. The upper end 39 of the rod 37 is pivotally secured at 41 to the frame member 5 of the bed top. It will be seen from the drawings that the upper end connection of the gas spring is between the leg brackets 7 and 9 to one side generally centrally of the table top.

The locking leg 43 comprises a sleeve 45 having a lower end pivotal connection 47 to the bed base directly opposite the lower end connection of the gas spring. An arm 49, which is telescopically fitted in the sleeve 45 has an upper end 51 which is pivotally connected at 53 to the table top frame 5 directly opposite the upper end connection of the gas spring. Accordingly, and as earlier noted, the locking leg is aligned with the gas spring on the other side of the table as will be clearly apparent from FIGS. 2 and 3 where the locking leg blocks the view of the gas spring.

The extendable arm portion 49 of the locking leg is provided with a series of openings 55 spaced along the length of the extendable arm. A spring loaded pin 57 extends through the sleeve 45 and is lockable into any one of the openings 55 of arm 49 depending upon the height to which the table top is adjusted.

Figure 2:
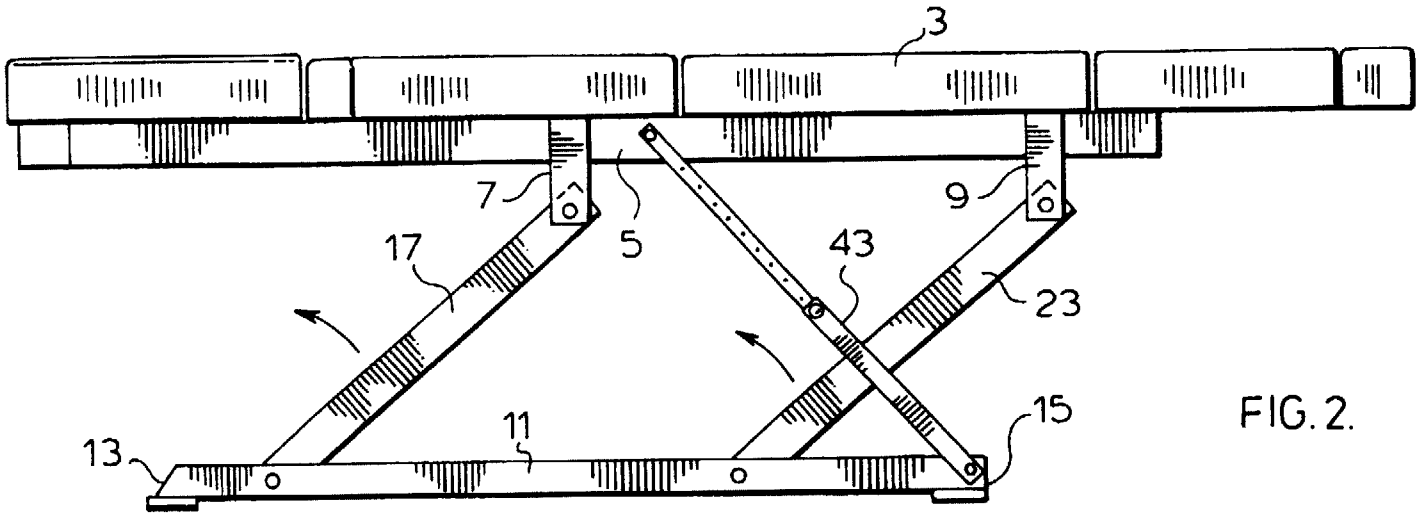
FIG. 2 is a side elevational view of the therapeutic table of FIG. 1 with the table top at an elevated height setting.
Figure 3:
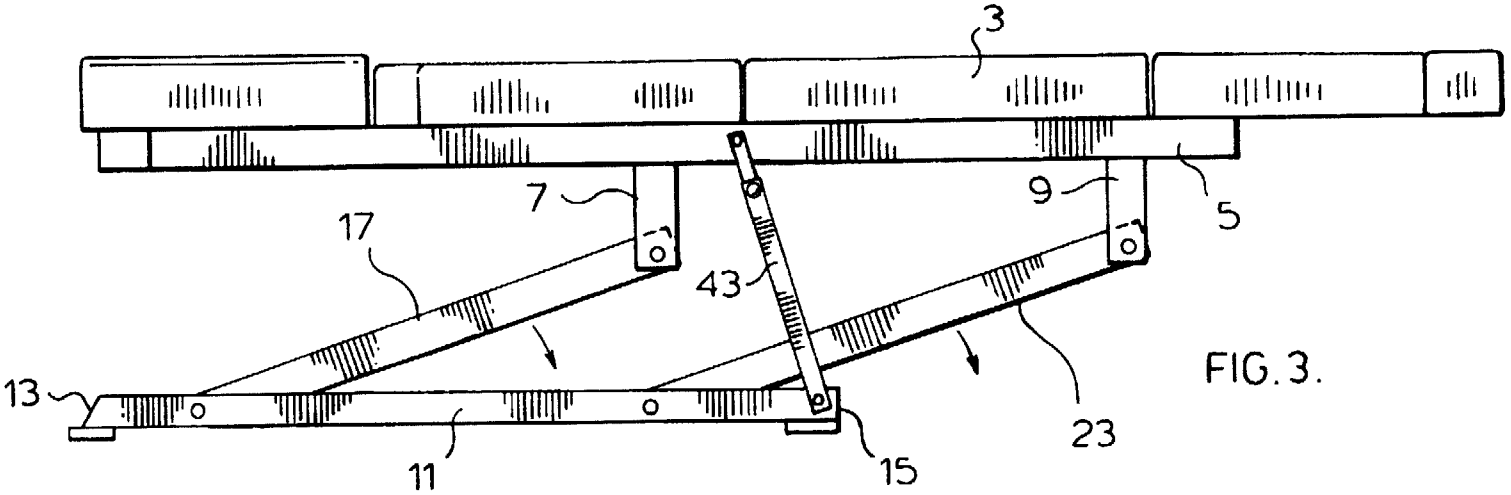
FIG. 3 is a front elevational view of the therapeutic table of FIG. 1 at a lowered height setting.

As will be seen in comparing FIGS. 2 and 3, the table top can be adjusted to different height settings. This is done without the patient on the table. The height to which the table top is set is determined by the practitioner using the table. When the table top is raised, the legs pivot upwardly in the direction indicated by the arrows in FIG. 2. When the table top is lowered, the legs pivot downwardly as indicated by the arrows in FIG. 3. As will be seen in comparing these two figures, the position of the legs not only dictates the height of the table top, but in addition, determines the lateral positioning of the table top relative to the base. In other words, in the FIG. 2 elevated position, the table top is generally centered over the base whereas in the FIG. 3 lowered position, the table top has been swung laterally to the right so that the base is located beneath the pillowed end of the table top.

In accordance with the present invention, gas spring 29 provides a lift assist which is helpful in adjusting height of the table top. In order to move the table top between height settings, the spring loaded pin 57 is retracted from the extendable arm portion 49 of the locking leg at which point there is nothing but the weight of the table top resisting extension of the gas spring. The table top then begins to slowly rise as a result of the lift provided by the gas spring. At the same time, the locking arm, which is a passive follower of the gas spring, begins to pivot and extend outwardly. When the table top has been elevated to the desired height, the spring loaded locking pin 57 is released springing back through the sleeve 45 and locking into the one of the apertures 55 of the extendable arm portion 45 which is aligned with the locking pin. This then locks against any further upward lifting of the table top. It also locks against any downward movement of the table top under the weight of the patient.

Gas spring 29 has sufficient spring pressure such that it substantially neutralizes weight of the elevated table top. In the preferred embodiment of the invention, gas spring 29 has a lifting capacity such that it slightly over compensates for the weight of the table top when the table top is in its preferred elevated position as shown for example in FIG. 2. If the table top needs to be lowered for use by a shorter practitioner, then only a minimal amount of weight needs to be placed on it to overcome the upward bias of the gas spring.

One feature of the invention that should be noted in comparing FIGS. 2 and 3 is that the gas spring, which is directly aligned with the locking leg, swings to a much steeper vertical angle when the table top is completely lowered. In this compressed state of the spring it has its greatest potential energy both because of its compression and its relatively vertical positioning where it pushes directly up on the table top. This is particularly useful in view of the fact that the table top is at a much lower and more awkward position to lift.

As the table top rises it also shifts sideways so that the upward angle of the gas spring decreases as it is extended and as the upward angling of the legs increases. The gas spring provides less upward pressure in the more elevated positions of the table top because the spring has been almost completely extended giving up much of its potential energy and because the spring is in a much more horizontal position. Therefore, only a very minimal downward weighting need be applied by the practitioner in order to prevent any further upward lift or to lower the table top when it is in the normal working elevated positions.

The lowered height setting of the table top as shown in FIG. 3 is not a normal working position but may be required for storage or shipping purposes.

Although various preferred embodiments of the present invention have been described herein in detail, it will be appreciated by those skilled in the art, that variations may be made thereto without departing from the spirit of the invention or the scope of the appended claims.

The embodiments of the invention in which an exclusive property or privilege is claimed are defined as follows:

1. A therapeutic table having a base, a bed like table top, height adjustable legs between said base and said table top to provide height adjustment of said table top, a gas spring providing an upward lift on and at least substantially neutralizing weight of said table top, and a lock having numerous locking positions for locking said table top at different heights to which said table top is adjusted, wherein said gas spring comprises a first telescopic strut pivotally connected between said base and said table top and wherein said lock comprises a second telescopic strut pivotally connected between said base and said table top, said second strut being passively controlled in both length and angular position by and in direct relation to said gas spring, said second strut having a series of spaced apart locking locations thereon for locking said table top at the different heights to which said table top is adjusted.

2. A therapeutic table having a base, a bed like table top, height adjustable legs between said base and said table top to provide height adjustment of said table top, a gas spring providing an upward lift on and at least substantially neutralizing weight of said table top, and a lock having numerous locking positions for locking said table top at different heights to which said table top is adjusted, wherein said gas spring has an upper end pivot connection centrally to one side of said table top between said legs and a lower end pivot connection with said base laterally off-set from said upper end pivot connection when said table top is in an elevated position, said legs carrying said table top sideways and downwards such that said upper end pivot connection of said gas spring is moved towards said lower end pivot connection of said gas spring and said gas spring moves towards a vertically upright position as said table top is lowered.

3. A therapeutic table as claimed in claim 2, wherein said lock comprises a telescopic strut having an upper end pivot connection to the other side of said table top aligned with the upper end pivot connection of said gas spring and a lower end pivot connection to said base aligned with the lower end pivot connection of said gas spring such that said telescopic strut and said gas spring are parallel with one another, said telescopic strut having a plurality of locking positions spaced lengthwise thereon for locking said table top at the different heights to which said table top is adjusted.

* * * * *